United States Patent [19]

Horodysky

[11] Patent Number: 4,919,831

[45] Date of Patent: Apr. 24, 1990

[54] MULTIFUNCTIONAL ESTER-TYPE ADDITIVES

[75] Inventor: Andrew G. Horodysky, Cherry Hill, N.J.

[73] Assignee: Mobil Oil Corporation, New York, N.Y.

[21] Appl. No.: 253,306

[22] Filed: Sep. 30, 1988

Related U.S. Application Data

[63] Continuation of Ser. No. 11, Jan. 2, 1987, abandoned.

[51] Int. Cl.[5] ..... C10M 135/12

[52] U.S. Cl. ..... 252/47.5; 252/48.2; 560/147

[58] Field of Search ..... 252/47.5, 48.2; 560/147

[56] References Cited

U.S. PATENT DOCUMENTS

| | | | |
|---|---|---|---|
| 2,683,119 | 7/1954 | Smith, Jr. et al. | 252/48.6 |
| 4,059,414 | 11/1977 | Holtz et al. | 44/58 |
| 4,128,483 | 12/1978 | Ishida et al. | 252/8.6 |
| 4,230,588 | 10/1980 | Bonazza et al. | 252/51.5 A |
| 4,249,912 | 2/1981 | Holtz et al. | 44/71 |
| 4,277,417 | 7/1981 | Varma | 260/456 R |

FOREIGN PATENT DOCUMENTS

| | | | |
|---|---|---|---|
| 697514 | 11/1964 | Canada | 252/48.2 |

*Primary Examiner*—Mark L. Bell
*Assistant Examiner*—Jerry D. Johnson
*Attorney, Agent, or Firm*—Alexander J. McKillop; Charles J. Speciale; Howard M. Flournoy

[57] ABSTRACT

Ester-type ashless dispersants containing additional integral sulfur-ester moieties which have been found to possess enhanced thermal oxidative stability are claimed.

11 Claims, No Drawings

MULTIFUNCTIONAL ESTER-TYPE ADDITIVES

This is a continuation of copending application Ser. No. 000,011, filed on Jan. 2, 1987 now abandoned.

BACKGROUND OF THE INVENTION

This application is directed to lubricant additives and compositions thereof. More particularly, this application is directed to lubricant oils and greases prepared therefrom containing an effective multifunctional amount of an ester-type polymer containing additional sulfur ester moieties, thereby providing exceptional dispersant/detergent activity and thermal stability.

The use of ester-containing or polymeric ester or polymeric ester/amide type carboxylic dispersants are well known, such as those described in U.S. Pat. Nos. 3,341,547, 3,632,510, 3,632,511, 3,697,428, or 3,725,441. These have been used in a variety of commercial lubricant and fuel applications for several decades.

The use of sulfur-ester containing additives have been reported in the literature, primarily in polymer stabilizing applications.

However no prior art known to applicant discloses and/or claims lubricant compositions comprising ester-type alkenyl succinic anhydride-derived ashless dispersants having additional integral sulfur-ester moieties.

SUMMARY OF THE INVENTION

It has been found that lubricant compositions containing small additive concentrations of ester-type polyalkenyl succinic anhydride-derived ashless dispersants containing additional integral sulfur-ester moieties possess significantly improved thermal and oxidative stability properties when compared to their non-sulfur-ester containing analogs. The sulfur-ester moieties can be introduced in many ways such as (A) during manufacture of the polymeric or oligomeric dispersant by co-reaction of (1) hydrocarbyl dibasic acid or anhydride, (2) polyol such as pentaerythritol, and (3) relatively small amounts of sulfur-containing acid such as 3,3'-thiodipropionic acid or more conveniently by, (B) reaction of (1) preformed polymeric ester dispersant with (2) relatively small amounts of sulfur-containing acid such as 3,3'-thiodipropionic acid. These preformed (intermediate product) ashless dispersants include any polymeric or oligomeric acid, anhydride or acid generating species reacted with a polyol or polyol amine to yield polymeric ester, amide, imide containing at least one free OH group available for reaction with sulfur containing acid or acid generating species.

It has now been found that the use of these novel ester-type polymers containing additional sulfur-ester moieties provide exceptional multifunctional dispersant/detergent activity, with additional thermal and oxidative stability properties without any deleterious increase in corrosivity or instability commonly expected with sulfur-containing additives.

Each of the major functionalities are believed to exert significant internal synergistic beneficial properties upon the final additive composition. The ester groups are believed to provide the basis for the dispersancy properties and the integral sulfur-ester groups incorporated with the dispersant molecule are believed to provide the additional unexpected thermal and oxidative stability improvements. These benefits are believed to be enhanced as a result of this novel internal synergism. This multifunctional/multipurpose additive approach is believed to have much wider applicability and may include a range of similar structures containing both (a) polymeric, oligomeric (preferably hexenyl, octenyl or decenyl) or hydrocarbyl ester, amide, imide, or mixed ester/amide/imide dispersant groups and (b) sulfur-ester, sulfonyl, or more generally sulfur-carboxyl containing moieties.

Accordingly this application is particularly directed to compositions comprising an oil of lubricating viscosity or grease thereof or liquid hydrocarbyl fuel and minor multifunctional amounts (dispersant/detergent-/antioxidant) of a polymeric, oligomeric or hydrocarbyl ester, amide, imide or mixtures thereof containing at least one free OH group and a sulfur-containing acid or acid generating species.

The remarkable benefits of this invention are also expected for a variety of synthetic and mineral oil based lubricants and greases and for hydrocarbon alcoholic, or hydrocarbon and alcoholic fuels intended for use in internal combustion engines or for heating applications. Both the compositions of matter described and the lubricant and fuel compositions containing same are believed to be novel. To the best of our knowledge, these compositions have not been previously used in lubricating oil, grease, or fuel applications.

Of particular significance in the present invention is the ability of the compositions of matter to provide not only resistance to oxidation but also provide improved anticorrosion characteristics.

DETAILED DESCRIPTION OF SPECIFIC EMBODIMENTS

A polymeric ester [made by the reaction of polyisobutenyl succinic anhydride (a condensation product of polyisobutylene and maleic anhydride) and pentaerythritol-type polyol] was reacted with thiodipropionic acid in the presence of hydrocarbon solvent at elevated temperatures until water evolution ceased to be observed in a Dean-Stark trap. The precise nature of the product is not known. The solvent was then removed by stripping under reduced pressure.

Useful polymeric esters also include those made from dimer acids such as dimerized linoleic acid, dimerized oleic acid and the like, polypropyl succinic anhydrides or acids or other similar acid or acid-generating compositions. Useful polymeric esters also include those made using other polyols or polyhydric alcohols such as trimethylolpropane or dipentaerythritol or tripentaerythritol or mixtures thereof as the polyol source, or tris(-hydroxymethyl)aminomethane. Typically the polyhydric alcohols include those containing 6 to about 30 carbon atoms and from about 3 to 6 hydroxyl groups.

Useful sulfur-ester generating species include 3,3'-thiodipropionic acid, dithiodipropionic acid, thiodibutanoic acid, similar sulfur-containing acids or anhydrides derived therefrom or mixtures of any, or all of the above or sulfur-containing similar acids containing aliphatic sulfur in the backbone of the acid.

The general scheme of the reaction may be described as follows:

A. Preformed Dispersant + Sulfur Acid → Desired product

B. hydrocarbyl anhydride or acid (1) + polyol intermediate product (dispersant) (2) + sulfur acid (3) ⟶ desired product Alternatively (3), the sulfur acid, may be reacted directly with (1) the hydrocarbyl anhydride or acid and the reaction product thereof is thereafter reacted with (2) the polyol. It is to be understood that (1), (2) and (3) may be simultaneously reacted if so desired.

Generally speaking, the polymeric ester is derived from an alkenyl succinic compound, i.e., an alkenyl succinic anhydride or acid. The alkenyl group can be polypropylene, polybutylene, polypentyl, oligomeric hexenyl, oligomeric oleyl, oligomeric decenes or mixtures of these or similar hydrocarbylene groups. Preferred is isobutylene succinic anhydride having a molecular weight in the range of about 300 to 3000, however, the alkenyl moiety may contain from 20 to about 36 carbon atoms or as many as 200 carbon atoms. Molecular weight ranges of 500–1500 are most preferred. The resulting polymeric ester after reaction with a polyol source must contain at least one free hydroxyl group, but can optionally contain additional hydroxyl and/or amine groups. Such polymers are readily available through normal commercial channels or can be prepared by known methods. The sulfur-generating species are all well known articles of commerce or can be prepared by any methods known to the art, preferred is dithiopropionic acid. The molar ratio of ester to sulfur species may vary from 1:1 to 1:0.001 with 1:0.5 to 1:0.01 being preferred. The reaction can take place at temperatures varying from about 90 to about 200° C. for about 3 to 12 hours or more generally under autogenous pressure. A solvent may be used if so desired. Any of the known hydrocarbon solvents, such as toluene, benzene, hexane and the xylenes are suitable. Diluent oil can also be used as a solvent.

The following examples and comparative data serve to illustrate the novel compositions of matter of the present invention and the marked improvement in detergent/dispersant and antioxidant corrosion properties of the hydrocarbon material containing same. It is to be understood however, that it is not intended that the invention be limited to the particular compositions containing same. Various modifications and compositions can be employed as would be readily apparent to those skilled in the art.

EXAMPLE 1

Polymer Ester-Thiodipropionic Acid Reaction Product

A mixture of 400 g polymeric ester in diluent oil [obtained commercially as Lubrizol 936-a polycarboxylate ester made by reacting polybutene with maleic anhydride and reacting the product formed (polybutylsuccinic anhydride) with pentaerythritol], 100 g toluene and 9 g thiodipropionic acid were charged to a 1 liter stirred reactor equipped with heater, agitator, Dean-Stark tube with condenser and an inert nitrogen atmosphere. The reactants were heated to 170°–175° C. for about six hours until water evolution during azeotropic distillation ceased. Approximately 3 ml water was collected. The solvent was removed by vacuum stripping at about 75° C. The product was a viscous fluid containing approximately 0.4% sulfur.

The product of Example 1 was blended into a 200 second solvent paraffinic neutral lubricating oil and evaluated by catalytic oxidation test at 325° F. for forty hours with the results shown in Table I. The non-sulfur containing ester used as a reactant in Example 1 was likewise blended into the identical oil and evaluated side-by-side in the same test.

TABLE 1

| | Catalytic Oxidation Test | | | | |
|---|---|---|---|---|---|
| Item | Additive Concentration In 200" SPN Oil | Sludge Rating | Percent Increase In Viscosity Measured at 40° C. | Percent Increase In Viscosity Measured at 100° C. | Lead Loss, mg |
| 1. Example 1 - Polymeric ester treated with thiodipropionic acid | 1.0 | Light | 51 | −13 | 0.9 |
| 2. Polymeric ester used as reagent for Example 1 | 1.0 | Heavy | 99 | 33 | 2.1 |

Samples of 200" solvent paraffinic neutral mineral lubricating oil were placed in an over at 325° F. Present in the samples were the following metals, either known to catalyze organic oxidation or commonly used materials of construction:

a. 15.6 sq. in. of sand-blasted iron wire
b. 0.78 sq. in. of polished copper wire
c. 0.87 sq. in. of polished aluminum wire
d. 0.167 sq. in. of polished lead surface.

Dry air was passed through the sample at a rate of about 5 liters per hour for 40 hours.

As can be seen from the above data, the sulfur-containing product of Example 1 controls the increase in viscosity of the test oil at both temperatures, the lead loss due to corrosivity, and the sludge formation (a measure of dispersancy-detergency) better than equal concentrations of the identical non-sulfur containing product.

The corrosivity of the products in accordance with the present invention were evaluated as shown in Table 2.

TABLE 2

| Item | Evaluation of Corrosivity - ASTM D130-6 Additive Concentration In 200" SPN Oil | Corrosivity Rating ASTM D130-6 | Corrosivity Rating ASTM D130 (6 Hrs. @ 100° C.) |
|---|---|---|---|
| 1. Example 1 - Polymeric ester treated with thiodipropionic acid | 1.0 | 1A | 1A |
| 2. Polymeric ester used as reagent for Example 1 | 1.0 | 1A | 1B |

The additive products described herein are effective in amounts ranging from 0.001 to about 10 wt. % and preferably from about 0.01 to about 5 wt. %. It is also understood that other additives for their known purposes, may be incorporated into the formulations of the present invention in amounts up to about 20 wt. % of the total composition. Included, for example, are friction-modifying, metal passivating, antiwear, bearing corrosion inhibitives, thermal stability additives and the like, metallic phenates and/or sulfonates, metallic or ashless phosphorodithioates, sulfurized olefins, polymeric pour depressants and other commonly used additives.

As can be seen from the above data, the products of of the invention are excellent with respect to control of copper corrosivity despite its sulfur content as well as having excellent oxidative and thermal stabilizing characteristics.

What is claimed is:

1. A composition comprising an oil of lubricating viscosity or grease prepared therefrom and a minor dispersant/detergent and/or antioxidant amount of an additive consisting of a polymeric, oligomeric or hydrocarbyl ester containing intergral sulfur-ester moieties prepared by reacting (1) a polycarboxylate ester made by the reaction of a $C_{20}$ to about a $C_{200}$ alkyl succinic anhydride or acid and a polyol having from about 6 to about 30 carbon atoms and from about 3 to about 6 hydroxyl groups, and containing at least one free hydroxyl group and having at least about 30 carbon atoms and (2) a sulfur-containing carboxylic acid or carboxylic acid generating species selected from the group consisting of thiodipropionic acid, dithiopropionic acid, thiodibutanoic acid, anhydrides thereof or mixtures thereof in a polymeric, oligomeric or hydrocarbyl ester to sulfur species molar ratio of from about 1:1 to about 1:0.001 at temperatures of from about 80° to about 200° C.

2. The composition of claim 1 wherein said ester containing intergral sulfur-ester moieties is derived from the group consisting of polypropylsuccinic or polyisobutenyl succinic anhydrides or acids, oligomeric succinic anhydrides or acids.

3. The composition of claim 2 wherein the oligomeric succinic acid or anhydride is selected from the group consisting of hexenyl, octenyl or decenyl succinic anhydrides or acids thereof.

4. The composition of claim 1 wherein the polyol is selected from the group consisting of trimethylol propane, dipentaerythritol, tripentaerythritol tris(hydroxymethyl)-aminomethane or mixtures thereof.

5. The composition of claim 1 wherein said polycarboxylate ester is derived from a polyisobutenyl succinic anhydride or acid and pentaerythritol.

6. The composition of claim 1 wherein the polycarboxylate ester is derived from a polyisobutenyl succinic anhydride or acid and pentaerythritol.

7. A composition comprising a major amount of an oil of lubricating viscosity or grease thereof and a minor dispersant/detergent and/or antioxidant amount of an additive product containing a polymeric, oligomeric or hydrocarbyl ester prepared by co-reacting (1) a $C_{20}$–$C_{200}$ polyalkenylhydrocarbyl anhydride or acid thereof, oligomeric alkenylhydrocarbyl anhydride or acid thereof, containing at least one free hydroxyl group and (2) a sulfur containing carboxylic acid or carboxylic acid generating species selected from the group consisting of thiodipropionic acid, dithiopropionic acid, thiodibutanoic acid, and anhydrides thereof or mixtures thereof and thereafter reacting the product of (1) and (2) with (3) a polyol having from 6 to about 30 carbon atoms and from about 3 to 6 hydroxyl groups.

8. The composition of claim 7 wherein said ester is derived from the group consisting of polypropylsuccinic or polyisobutenyl succinic anhydrides or acids, oligomeric succinic anhydrides or acids.

9. The composition of claim 7 wherein the polyol is selected from the group consisting of trimethylol propane, dipentaerythritol, tripentaerythritol (tris(hydroxymethyl)aminomethane or mixtures thereof.

10. The composition of claim 7 wherein said alkenylhydrocarbyl or polyalkenylhydrocarbyl anhydride or acid is derived from the group consisting of polypropylsuccinic or polyisobutenyl succinic anhydrides or acids, oligomeric succinic anhydrides or acids.

11. The composition of claim 10 wherein the oligomeric succinic acid or anhydride is selected from the group consisting of hexenyl, octenyl or decenyl succinic anhydrides or acids thereof.

* * * * *